US007597595B2

(12) United States Patent
Ohashi et al.

(10) Patent No.: US 7,597,595 B2
(45) Date of Patent: Oct. 6, 2009

(54) TERMINAL CONNECTION STRUCTURE

(75) Inventors: Norihiro Ohashi, Shizuoka-ken (JP); Asako Takahashi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/203,645

(22) Filed: Sep. 3, 2008

(65) Prior Publication Data

US 2009/0068894 A1 Mar. 12, 2009

(30) Foreign Application Priority Data

Sep. 12, 2007 (JP) ..... P2007-236727

(51) Int. Cl.
*H01R 4/38* (2006.01)

(52) U.S. Cl. ..... 439/766; 439/522

(58) Field of Classification Search ..... 439/766, 439/522, 801, 212, 949
See application file for complete search history.

(56) References Cited

U.S. PATENT DOCUMENTS 6,551,147 B2 * 4/2003 Wakata et al. ..... 439/754
6,723,920 B2 * 4/2004 Higuchi et al. ..... 174/50
6,902,434 B2 * 6/2005 Stack ..... 439/620.28
6,939,167 B2 * 9/2005 Kosuge ..... 439/522
7,192,319 B1 * 3/2007 Rahman et al. ..... 439/766
2005/0285709 A1 12/2005 Matsumura et al.

FOREIGN PATENT DOCUMENTS

| | | |
|---|---|---|
| EP | 1 239 506 A2 | 9/2002 |
| JP | 62-211877 | 9/1987 |
| JP | 7-263043 | 10/1995 |
| JP | 8-83632 | 3/1996 |
| JP | 2005-310710 | 11/2005 |

* cited by examiner

*Primary Examiner*—Hien Vu
(74) *Attorney, Agent, or Firm*—Finnegan, Henderson, Farabow, Garrett & Dunner, L.L.P.

(57) ABSTRACT

In a terminal connection structure, a stud bolt is stood and inserted into a hole of a top plate portion of a terminal, and the nut is screwed and fastened to the stud bolt on the top plate, thus connecting the terminal to the stud bolt. A terminal accommodation section is formed by a tubular wall around the stud bolt. It has an opening and ribs at a part of a circumference thereof, and allows the terminal fixed to the stud bolt from above. The opening is formed so as to fit on a belt portion extending from the top plate portion toward a fixing portion of the terminal. The ribs are protruded on the protection wall. The ribs prevent the terminal from being detached upward when the terminal is being temporarily lifted. The ribs are arranged at different heights in a top-bottom direction of the stud bolt.

6 Claims, 9 Drawing Sheets

TERMINAL CONNECTION STRUCTURE

CROSS REFERENCE TO RELATED APPLICATION

This application is based upon and claims the benefit of priority from Japanese Patent Application No. 2007-236727 filed on Sep. 12, 2007, the entire contents of which are incorporated herein by reference.

BACKGROUND OF THE INVENTION

1. Field of the Invention

The present invention relates to a terminal connection structure for connecting a stud bolt standing on a fusible link unit or the like to a terminal with wire (called as an LA terminal) using a nut.

2. Description of the Related Art

To fix a perforated terminal with wire (generally called as an LA terminal) to a terminal connection portion of the other member using a bolt, before the bolt is fastened, the terminal is positioned so as not to move. In this case, the bolt is inserted into a hole of the terminal with the terminal engaged with a rib (a latch craw) which restricts the position of the terminal to the terminal connection portion of the other member, and the terminal is then fixed to the terminal connection portion of the other member (see Japanese Patent Laid-open Publications No. 62-211877 and No. 7-263043).

SUMMARY OF THE INVENTION

In each of the conventional structures described in the aforementioned patent literatures, a pair of ribs (latch claws) are provided to catch the terminal at both sides, and the both ribs are positioned at the same height. This is because the terminal is slid from the side and inserted under the ribs and the ribs do not need to be provided at different heights at all. Sliding and inserting the terminal from the side into a fixing position in such a manner is because the connecting style is not the stud bolt method but a fixing method of first inserting the terminal under the ribs and then inserting the bolt into the terminal.

In the case of the fixing method of standing the stud bolt in the terminal connection portion and fitting the terminal onto the stud bolt, the pair of ribs provided at the same height to prevent detachment of the terminal make it difficult to insert the terminal under the ribs.

In the light of the aforementioned circumstances, an object of the present invention is to provide a terminal connection structure in which the terminal with wire is not detached from a stud bolt even if upward force is applied to the wire after the stud bolt is inserted from above into a bolt insertion hole of the terminal, thus allowing the nut to be reliably and easily attached to the stud bolt and in which the terminal can be easily fit on the stud bolt.

An aspect of the present invention is a terminal connection structure in which a stud bolt is stood and inserted into a bolt insertion hole of a top plate of a terminal, and the nut is screwed and fastened to the stud bolt on the top plate, thus connecting the terminal to the stud bolt. The structure comprises: a terminal accommodation section formed by a tubular protection wall around the stud bolt, having an opening and ribs at a part of a circumference thereof, the terminal accommodation section allowing the top plate of the terminal fixed to an end of a wire to be inserted in the tubular protection wall on the stud bolt from above. The opening is formed so as to fit on a belt portion extending from a part of an outer peripheral edge of the top plate of the terminal toward a fixing portion of the terminal. The ribs are protruded on right and left side walls included in the protection wall with respect to the opening, the ribs coming into contact with the right and left side edges of the belt portion of the terminal and preventing the terminal from being detached upward when the terminal is being temporarily lifted. The ribs are arranged at different heights in a top-bottom direction of the stud bolt.

In the terminal connection structure according to the present invention, the ribs respectively may have: guide slope surfaces in upper surfaces thereof, the guide slope surfaces sloping downward from a base side of the ribs toward a tip side of the ribs to facilitate the insertion of the terminal when the terminal to be inserted into the terminal accommodation section comes into contact with the ribs; and latch surfaces in lower surfaces thereof, the latch surfaces being normal to the protection wall, or having a slope sloping up from the tip side of the ribs to the base side of the ribs.

In the terminal connection structure according to the present invention, the fixing portion of the wire is preferably bent downward in an L shape with respect to the belt portion, and the wire preferably extends downward from the fixing portion of the wire.

Moreover, in the terminal connection structure according to the present invention, A plurality of the stud bolts and a plurality of the tubular protection walls are preferably provided side by side in an upper surface of a component. Further, preferably, a plurality of wire accommodation grooves is formed on a side of the component. Each of the wire accommodation grooves preferably accommodates the fixing portion of the wire and an upper end part of the wire. Each of the wire accommodation grooves preferably communicates with the opening of the tubular protection walls.

In addition, the top plate of the terminal may be formed in a disk shape and include a protrusion at a part of a circumference thereof. The tubular protection walls may be cylindrical protection walls. Each of the tubular protection walls may have a recess fitting on each of the protrusions at a part of the circumference thereof. The protrusions of the terminals may be arranged at different circumferential positions from each other, and the recesses of the cylindrical protection walls may be arranged at different circumferential positions corresponding to the protrusions.

In the terminal connection structure according to the present invention, preferably, the component is a fusible link unit directly mounted on a battery.

According to the present invention, the top end plates of the terminals are inserted into the terminal accommodation units from above, thus allowing the stud bolts to be fit into the bolt insertion holes of the top plates of the terminals, respectively.

At the insertion, the belt portions of the terminals pass the ribs to be positioned below the ribs. In this case, the ribs prevent the terminals from being detached upward. It is therefore possible to screw and fasten the nuts to the stud bolts onto the terminals prevented from being detached without holding the wires extending from the terminals in particular. Accordingly, the terminals can be easily and reliably connected to the stud bolts.

DESCRIPTION OF THE EMBODIMENT

Hereinafter, a description is given of an embodiment of the present invention with reference to the drawings.

Figure 1:
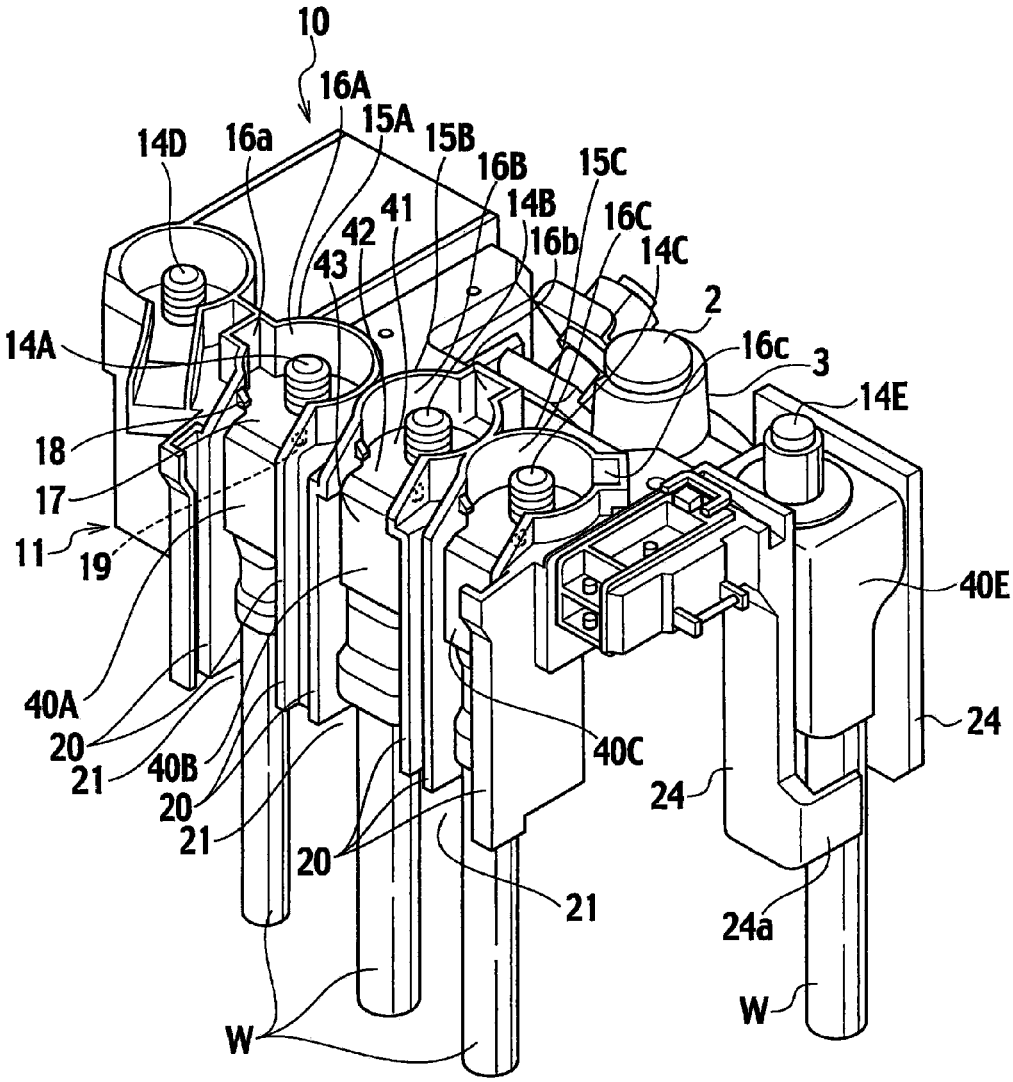
FIG. 1 is a perspective view of a fusible link unit to which terminals are attached but not fastened with nuts, showing an embodiment of the present invention.
Figure 2:
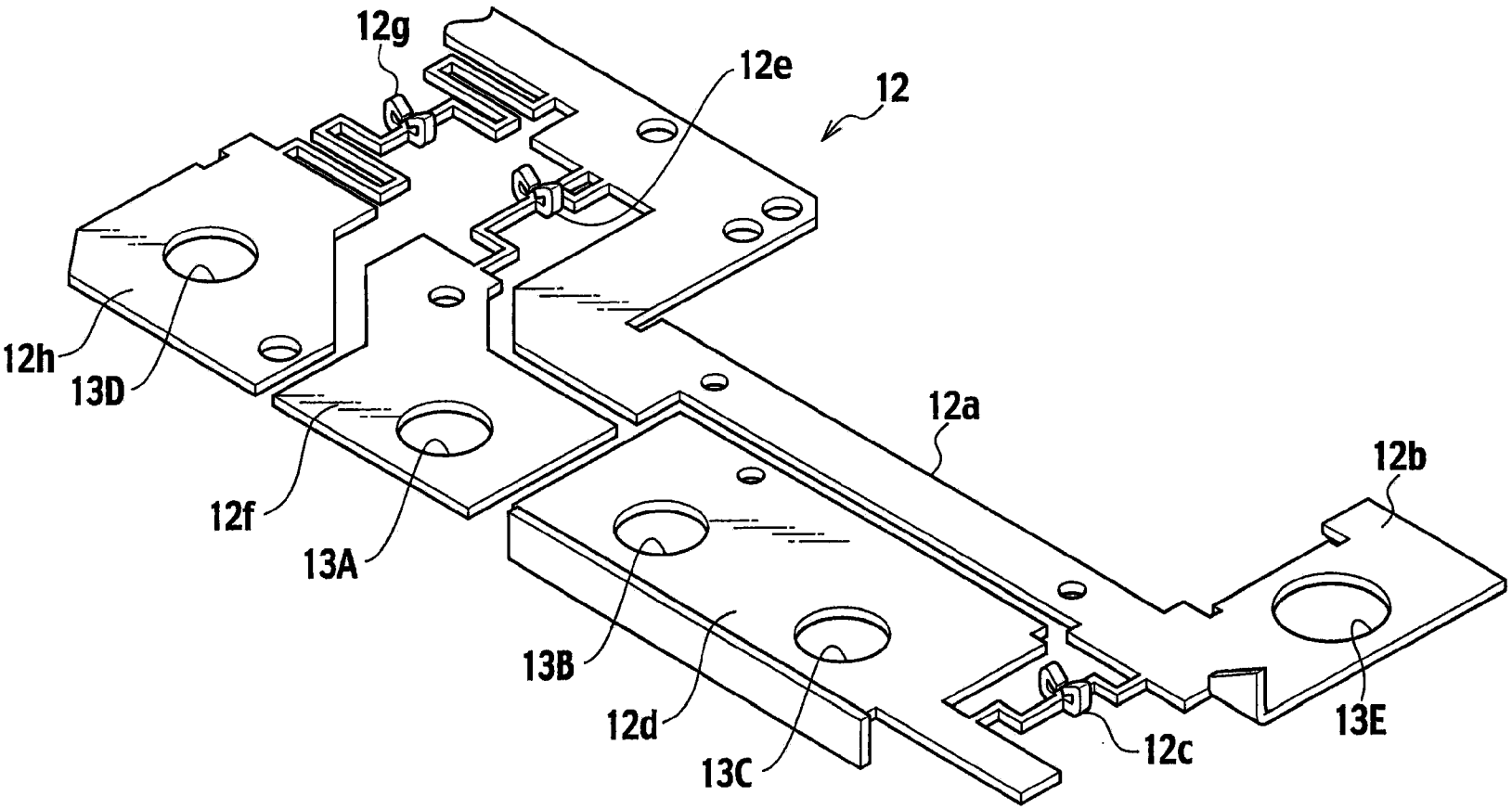
FIG. 2 is a perspective view showing a structure of a busbar incorporated in the fusible link unit.
Figure 9:
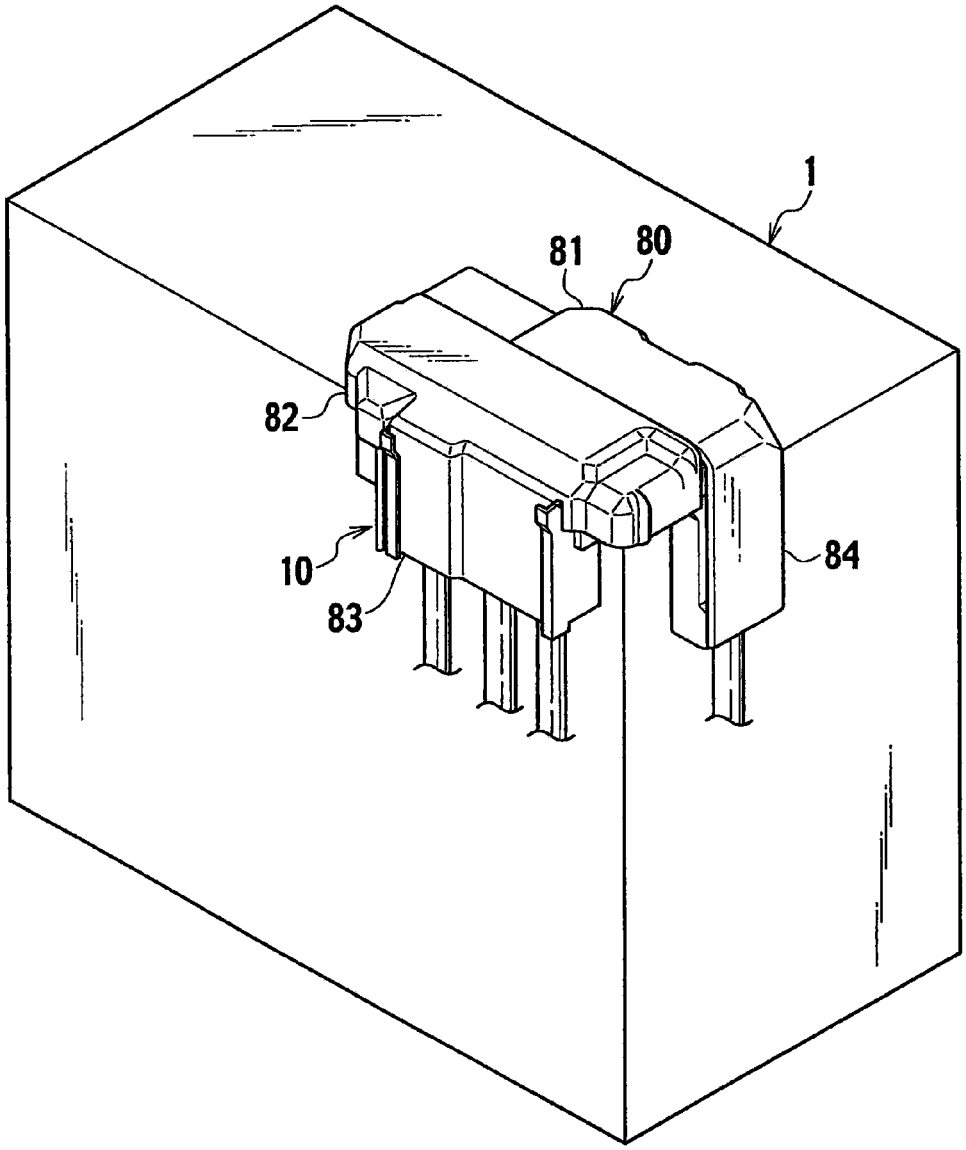
FIG. 9 is an exterior perspective view of a battery to which the fusible link unit covered with a protection cover is mounted.

A terminal connection structure of the embodiment includes a fusible link unit 10 directly mounted on a battery 1 as shown in FIGS. 1 and 9. The fusible link unit 10 is attached to a battery post 2 with a battery terminal 3 interposed therebetween. The fusible link unit 10 includes a busbar 12 press-molded as shown in FIG. 2 within a housing 11 made of mold resin.

The busbar 12 includes: an input plate portion 12*a* having an input terminal plate 12*b* at an end; and output plate portions 12*d*, 12*f*, and 12*h* connected to the input plate portion 12*a* through fuse elements (fusible portions) 12*c*, 12*e*, and 12*g*, respectively. In the input terminal plate 12*b*, a hole 13E, through which a stud bolt 14E is inserted, is formed. In the output plate portions 12*d*, 12*f*, and 12*h*, holes 13A to 13D, through which the stud bolts 14A to 14D are inserted, are formed, respectively.

The fusible link unit 10 shown in FIG. 1 is formed by molding necessary part of the busbar 12 with resin constituting the housing 11 after the stud bolts 14A to 14E are inserted into the holes 13A to 13E of the busbar 12, respectively. In the upper surface of the housing 11 of the fusible link unit 10, the stud bolts 14A to 14E are protruded. The portions of the stud bolts 14A to 14E protruded from the upper surface of the housing 11 serve as terminal connecting sections to which the terminals with wire are connected. The connection structure of the embodiment of the present invention is applied to the three terminal connecting sections on the output side among the terminal connecting sections, as an example.

Figure 3:
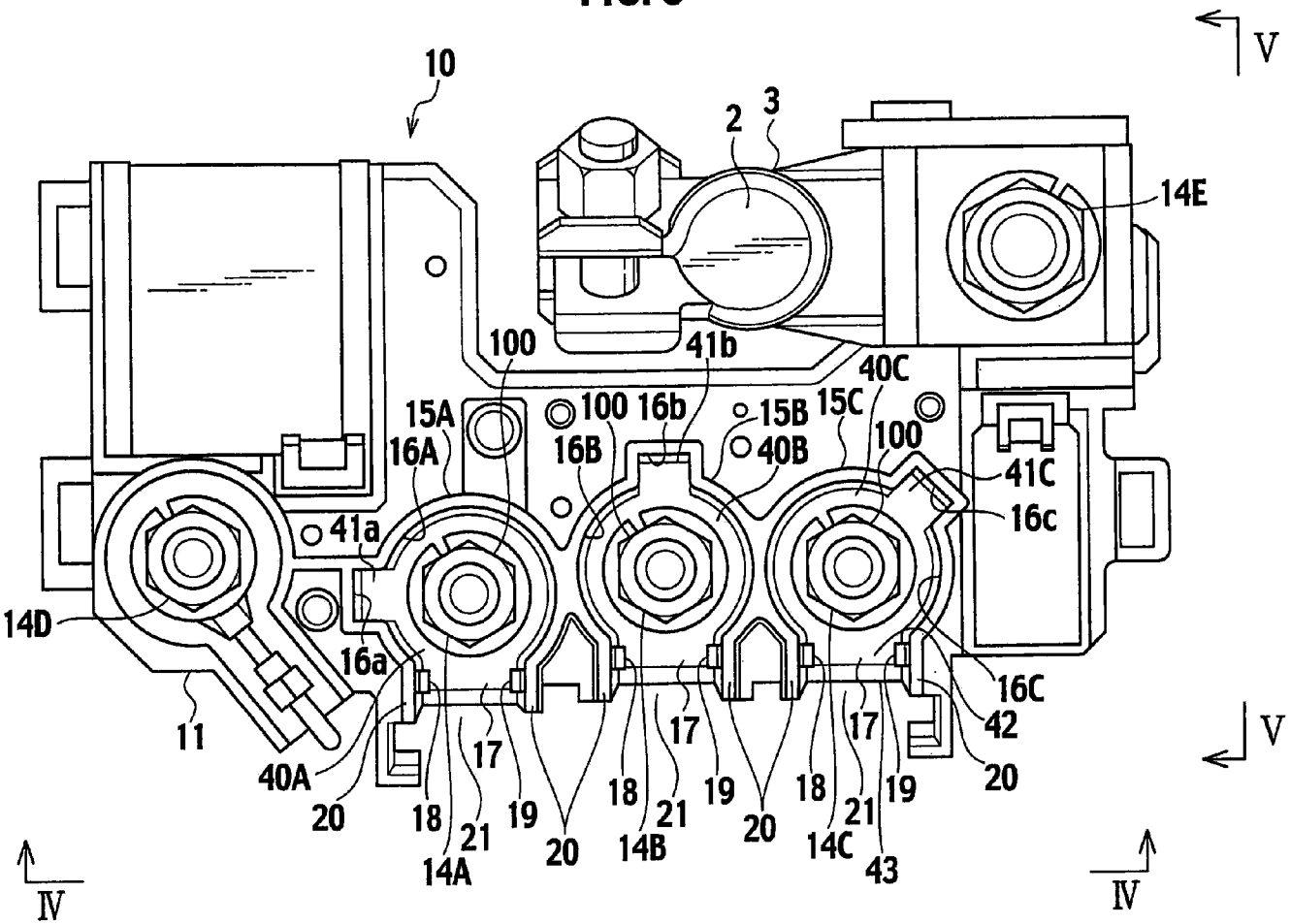
FIG. 3 is a plan view of the fusible link unit with the terminal being fastened with the nut.
Figure 4:
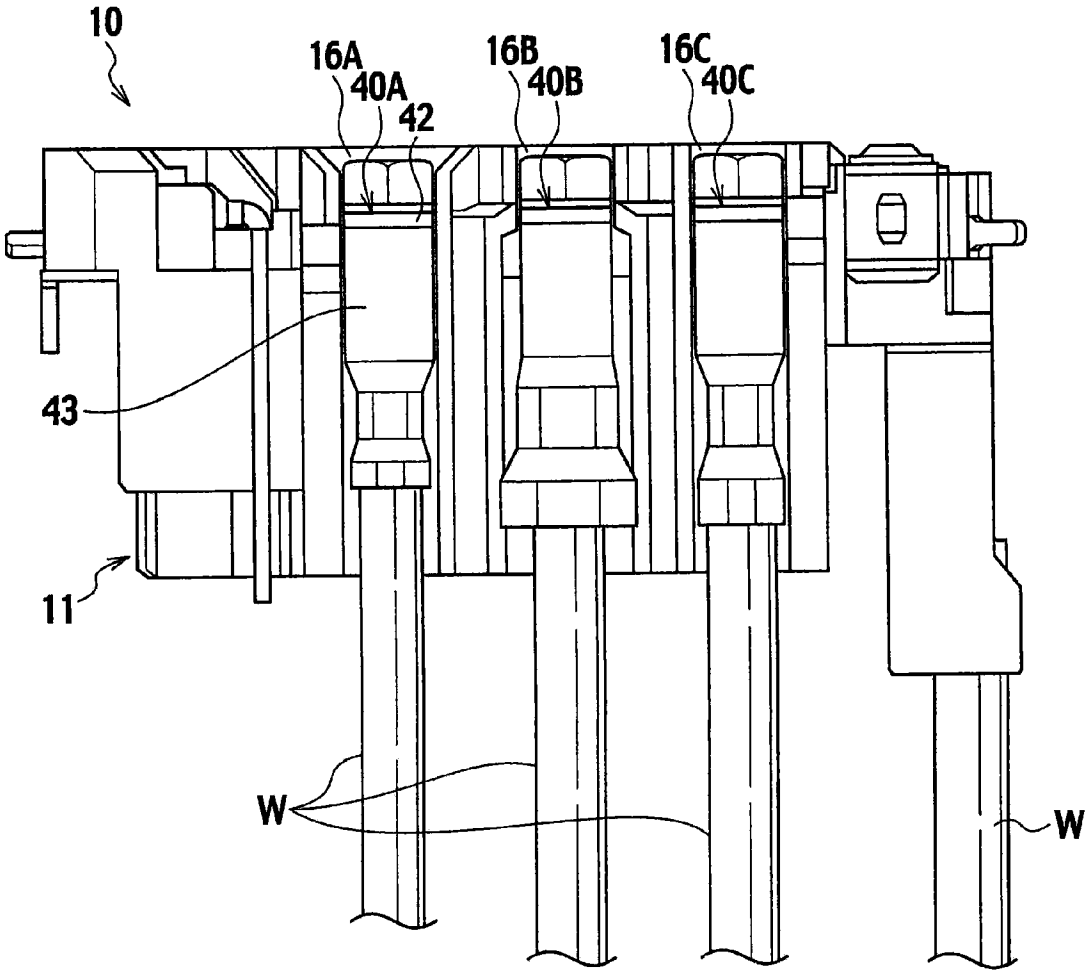
FIG. 4 is a IV-IV arrow view of FIG. 3.

In these three terminal connecting sections, as shown in FIG. 3, the stud bolts 14A to 14C protruded upward are inserted into bolt insertion holes (not shown) of top plate portions 41 of the terminals 40A to 40C fixed to ends of wires W, and nuts 100 are screwed and fastened to the stud bolts 14A to 14C onto the top plate portions 41. The terminals 40A to 40C are thus connected to the stud bolts 14A to 14C, respectively.

Figure 5:
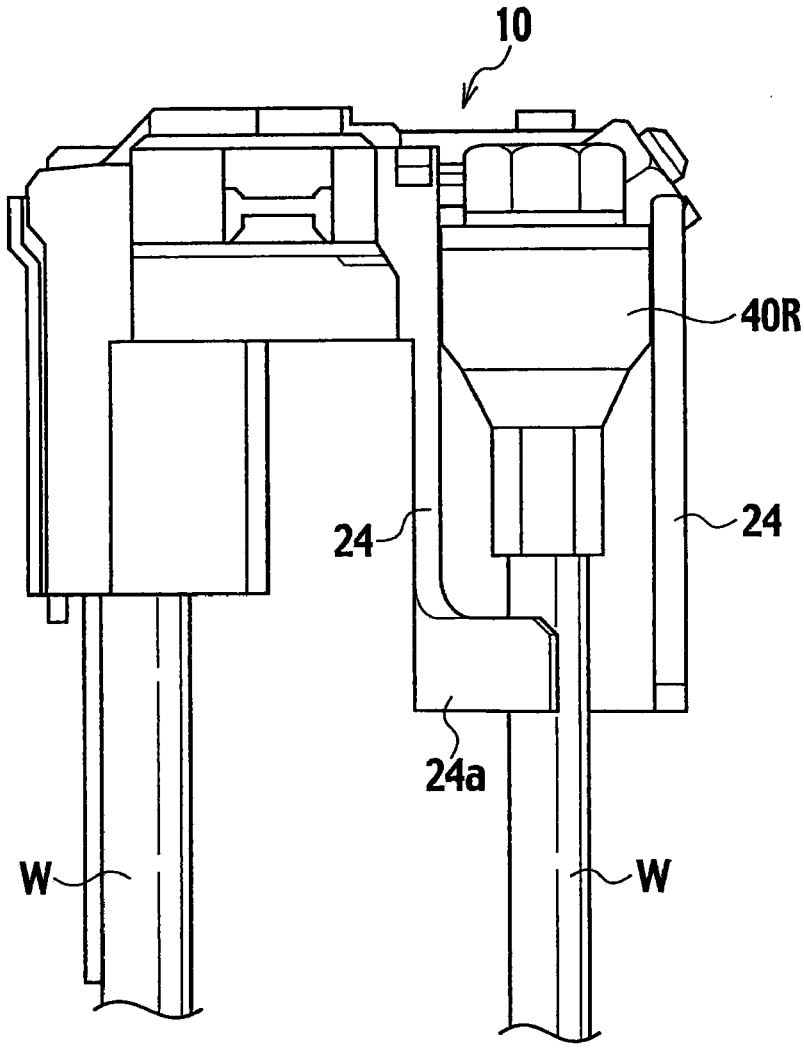
FIG. 5 is a V-V arrow view of FIG. 3.

The other terminal connecting sections have the substantially same structure. The stud bolt 14E for an input terminal is fastened to the battery terminal 3 and terminal 40E with wire in particular as shown in FIGS. 1 and 5. On both sides of the stud bolt 14E, side walls 24 are provided, and the terminal 40E with wire is accommodated between the side walls 24, 24. At a bottom end of one of the side walls 24, a wire restriction portion 24*a* is provided to prevent a wire W accommodated between the side walls from being detached.

Around the three stud bolts 14A to 14C, cylindrical protection walls 15A to 15C respectively corresponding to the disk-shaped top plate portions 41 of the terminals 40A to 40C are formed in a line. Within the cylindrical protection walls 15A to 15C, terminal accommodation portions 16A to 16C are defined, into which the top plate portions 41 of the terminals 40A to 40C can be inserted onto the stud bolts 14A to 14C, respectively. At parts of the circumferences of the cylindrical protection walls 15A to 15C, openings 17, to which belt portions 42 are fit, are individually provided. The belt portions 42 are extended from respective parts of peripheral edges of the top plate portions 41 of the terminals 40A to 40C toward wire crimping portions (fixing portions) 43.

Figure 6A:
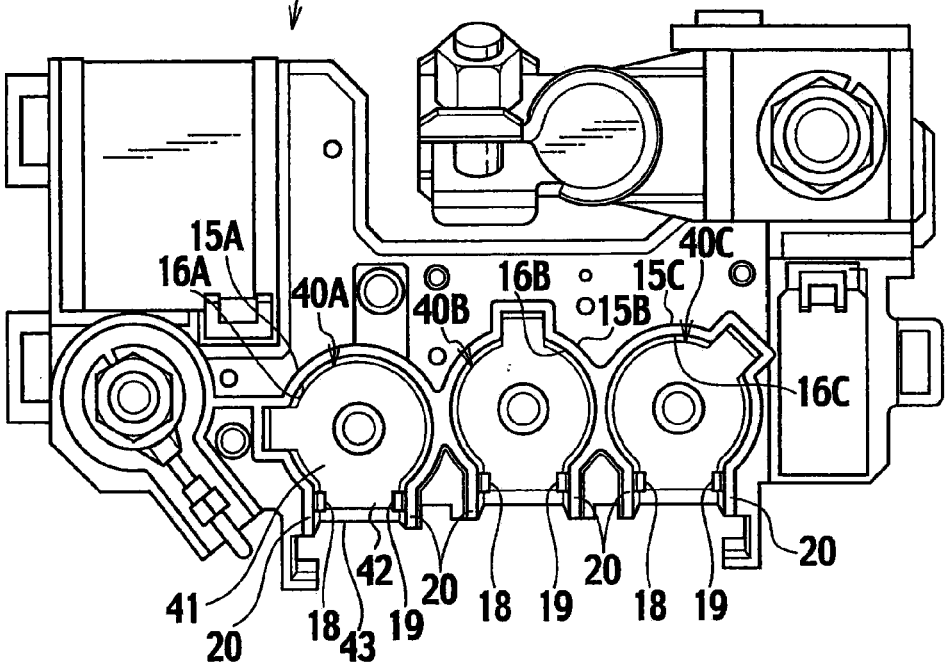
FIGS. 6A to 6C are respectively: a plan view of the fusible link unit with the terminals attached thereto; a cross-sectional side view of one of terminal attachment portions in which the terminal is caught by a lower rib; and an enlarged view of a VI portion of FIG. 6B.
Figure 6B:
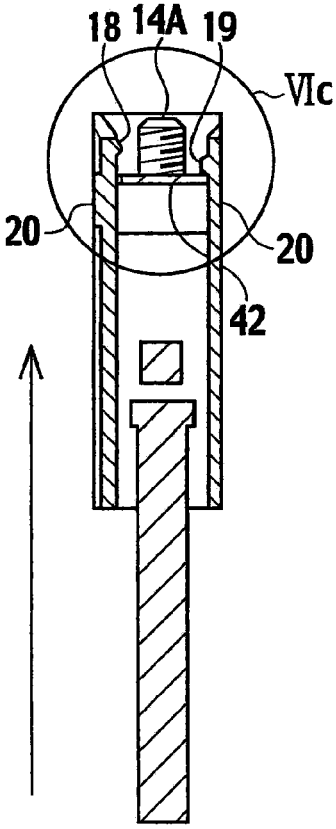
Figure 6C:
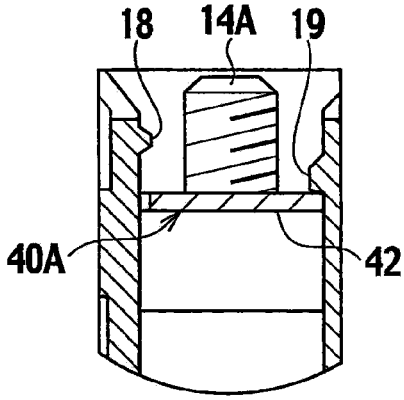
Figure 7A:
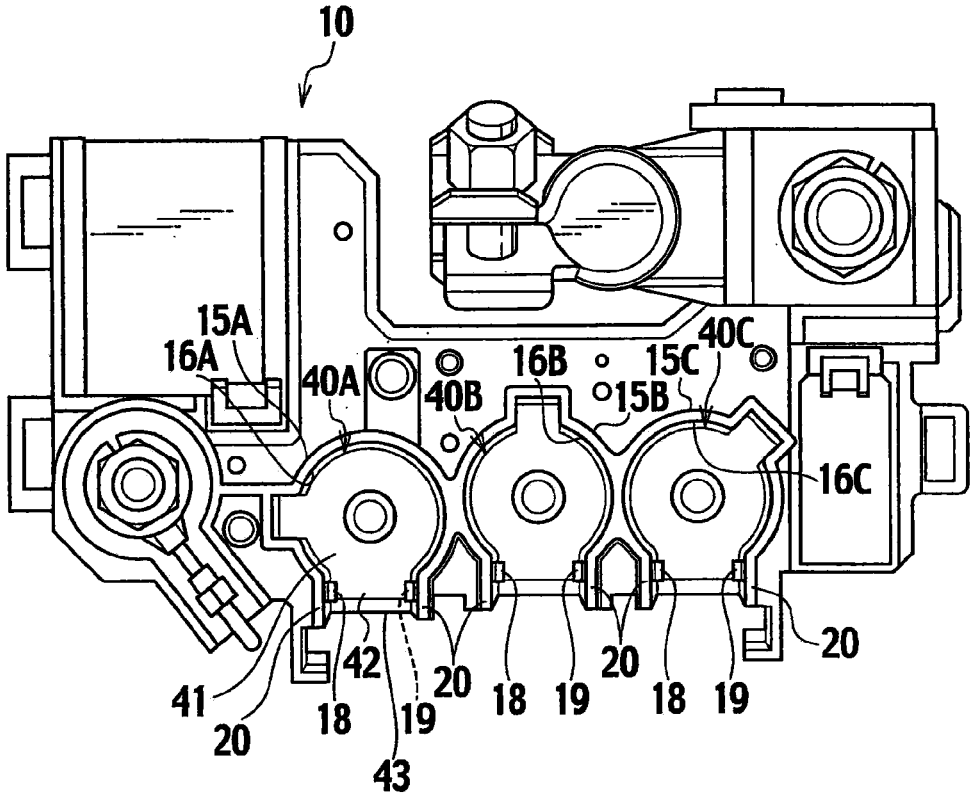
FIGS. 7A to 7C are respectively: a plan view of the fusible link unit with the terminals attached thereto; a cross-sectional side view of one of the terminal attachment portions in which the terminal is latched by an upper rib; and an enlarged view of a VI portion of FIG. 7B.
Figure 7B:
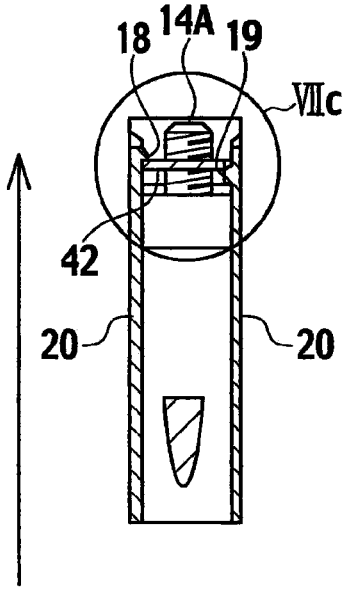
Figure 7C:
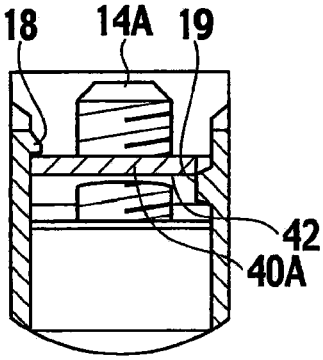
Figure 8A:
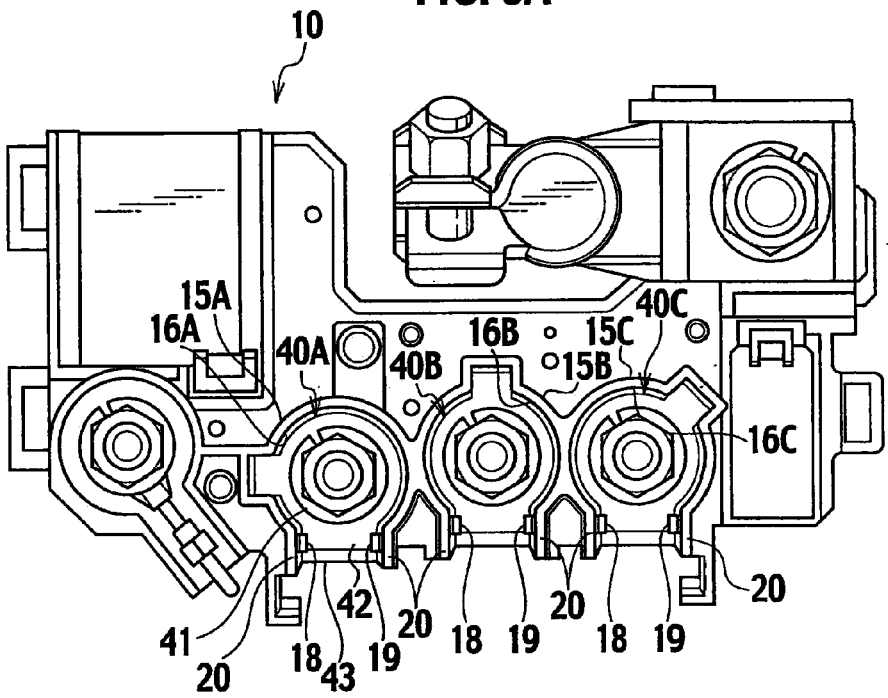
FIGS. 8A and 8B are respectively: a plan view of the fusible link unit with the terminals attached thereto; and a cross-sectional side view of three of the terminal attachment portions in which the terminals are latched by the lower ribs.
Figure 8B:
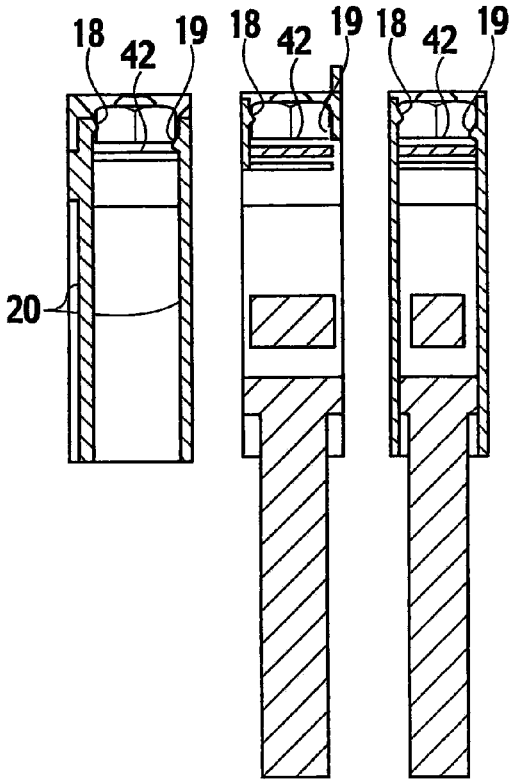

As shown in FIGS. 6 to 8, ribs 18 and 19 are protruded on right and left side walls 20 of each opening 17. When the terminals 40A to 40C once inserted to the base positions of the stud bolts 14A to 14C temporarily are lifted, the ribs 18 and 19 come into contact with respective edges of the belt portion 42 of each of the terminals 40A to 40C, thus preventing the terminals 40A to 40C from being detached upward. The right and left ribs 18 and 19 are arranged at different positions in the direction that the stud bolts 14A to 14C extend.

Each wire crimping portion 43 of the terminals 40A to 40C is bent downward into an L shape from the belt portion 42 protruding in the same plane as that of the top plate portion 41, and the wire W is extended downward from each wire crimping portion 43.

Moreover, in a side surface of the housing 11, wire accommodation grooves 21 are formed so as to be continuous to the respective openings 17. The wire accommodation grooves 21 are secured between right and left side walls 20 which are continuous to the respective cylindrical protection walls 15A to 15C and can accommodate the wire crimping portions 43 and upper part of the wires W.

At parts of the circumferences of the cylindrical protection walls 15A to 15C, recesses 16*a* to 16*c* are provided, respectively. To the recesses 16*a* to 16*c*, protrusions 41*a* to 41*c* protruded at parts of the circumferences of the disk-shaped top plate portions 41 of the terminals 40A to 40C are fit, respectively, thus determining the relative positions between the cylindrical protection walls 15A to 15C and the top plate portions 41. These protrusions 41*a* to 41*c* are positioned at different circumferential positions of the terminals 40A to 40C, and corresponding to the protrusions 41*a* to 41*c*, the recesses 16*a* to 16*c* are positioned at different circumferential positions of the cylindrical protection walls 15A to 15C. In other words, the arrangement of these protrusions and recesses prevents misplacement of the terminals 40A to 40C with wire.

In the upper surfaces of the ribs 18 and 19, guide slope surfaces sloping downward from the base end thereof toward the tip end are provided when needed. After the terminals 40A to 40C come into contact with the upper surfaces of the ribs 18 and 19, the guide slope surfaces facilitate further insertion of the terminals 40A to 40C into the terminal accommodation units 16A to 16C, respectively. Moreover, in bottom surfaces of the ribs 18 and 19, latch surfaces are provided, which come into contact with the terminals 40A to 40C at right angles when the terminals 40A to 40C lift and come into contact with the ribs 18 and 19. Alternatively, in the bottom surfaces of the ribs 18 and 19, latch surfaces composed of surfaces sloping up from the top end toward the base end.

Next, a description is given of an operation of the same.

In the fusible link unit 10, the top end plate portions 41 of the terminals 40A to 40C are inserted into the terminal accommodation units 16A to 16C from above, thus allowing the stud bolts 14A to 14C to be fit into the bolt insertion holes of the top plate portions 41 of the terminals 40A to 40C, respectively.

At the insertion, the belt portions 42 of the terminals 40A to 40C pass the ribs 18 and 19 to be positioned below the ribs 18 and 19. In this case, the ribs 18 and 19 prevent the terminals 40A to 40C from being detached upward. It is therefore possible to screw and fasten the nuts 100 to the stud bolts 14A to 14C onto the terminals 40A to 40C prevented from being detached without holding the wires W extending from the terminals 40A to 40C in particular. Accordingly, the terminals 40A to 40C can be easily and reliably connected to the stud bolts 14A to 14C.

At this time, for example, if the right and left ribs 18 and 19 are at the same height, it is very difficult to insert the belt portions 42 of the terminals 40A to 40C under the ribs 18 and 19 from above although the ribs 18 and 19 exert strong force to prevent detachment. Especially if the both side walls 20 of the openings of the cylindrical protection walls 15A to 15C have high rigidity, it is difficult to cause the belt portions 42 to be passed under the both ribs 18 and 19 at the same height using flexibility of the both side walls 20.

Herein, one of conditions necessary for assembly of the terminals 40A to 40C is that the terminals 40A to 40C need to be inserted from above instead of being slid from the side like the conventional example because the top plate portions 41 of the terminals 40A to 40C need to be fit onto the stud bolts 14A to 14C standing.

On the other hand, in the embodiment, the right and left ribs 18 and 19 are positioned at different heights in the top-bottom direction of the stud bolts 14A to 14C. Accordingly, the belt portions 42 of the terminals 40A to 40C do not need to pass the both ribs 18 and 19 at the same time. Accordingly, the terminals 40A to 40C can be more easily inserted into the terminal accommodation units 16A to 16C, respectively. In other words, the belt portions 42 only should pass one of the ribs 18 and 19 at a time to be inserted under the ribs 18 and 19, thus facilitating the insertion.

Even though lifting force in a direction where the stud bolds 14A to 14C are detached acts on the terminals 40A to 40C after the terminals 40A to 40C are inserted to the base positions of the stud bolts 14A to 14C, the side edges of the belt portions 42 of the terminals 40A to 40C first come into contact with the ribs 19 at the lower side as shown in FIGS. 6 and 8, thus preventing the terminals 40A to 40C from being detached.

Moreover, even if the lifting force further acts on each of the terminals 40A to 40C and the terminal 40A to 40C is inclined and unlatched from the rib 19 positioned at the lower side, as shown in FIG. 7, the belt portion 42 is caught by the rib 18 positioned at the upper side in the opposite surface, so that the terminals 40A to 40C can be prevented from being detached. Moreover, when the terminals 40A to 40C become inclined, edges of the bolt insertion holes become more likely to be caught by thread grooves of the stud bolts 14A to 14C, so that the terminals 40A to 40C can be prevented from being detached. The terminals 40A to 40C can be therefore reliably prevented from being detached, thus facilitating fastening the nuts 100.

Depending on the heights of the ribs 18 and 19, some terminals (two or more terminals) can be fastened together to each of the stud bolts 14A to 14C by the nut 100. Also in such a case, it is possible to easily attach and fasten the nuts 100 to the stud bolts 14A to 14C while preventing the terminals from being detached.

In the case where the guide slope surfaces are provided in the upper surfaces of the ribs 18 and 19, the terminals 40A to 40C can be easily inserted under the ribs 18 and 19. When the latch surfaces composed of the surfaces coming into contact with the terminals 40A to 40C at right angles or the surfaces sloping up from the base end toward the top end are provided in the lower surfaces of the ribs 18 and 19, the force catching the terminals can be reliably exerted.

In the fusible link unit 10 of this embodiment, the lifting force acting on the terminals 40A to 40C from the wires W extending downward can be reliably received by the ribs 18 and 19. It is therefore possible to prevent detachment of the terminals 40A to 40C and facilitate fastening the nuts 100. For example, since the wires W for output are thick in many cases, when the longitudinal tension is applied to the wires W, the tension acts on the wire crimping portions 43 of the terminals 40A to 40C, and the terminals 40A to 40C tend to be exposed to large lifting force. This lifting force then acts on the top plate portions 41 through the belt portions 42. However, the belt portions 42 are held by the ribs 18 and 19, and the terminals 40A to 40C can be effectively prevented from being lifted as a whole.

Because of the operation of the ribs 18 and 19, all of the terminals 40A to 40C are held so as not to be lifted while the nuts 100 are being screwed on the stud bolts 14A to 14C with the plurality of terminals 40A to 40C being accommodated in the terminal accommodation units 16A to 16C. This eliminates the need to hold the wires W while fastening the nuts 100, thus facilitating fastening all of the nuts 100.

Moreover, the cylindrical protection walls 15A to 15C are provided with the recesses 16*a* to 16*c* for positioning. It is therefore possible to prevent incorrect assembly of the plurality of terminals 40A to 40C.

Moreover, even when tension acts on the wires W to be connected to the fusible link unit 10, the terminals with wire can be fastened to the stud bolts 14A to 14C and 14E of the fusible link unit 10 with the nuts 100. Specifically, wires connected to the battery-mounted fusible link unit are thick in many cases, and when tension acts on the wires, the terminals are exposed to large lifting force because of the tension of the wires while the terminals are fit on the stud bolts and the nuts are fastened. Accordingly, the terminals are sometimes detached from the stud bolts. In such a case, the wires need to be held while the nuts are screwed to the stud bolts. However, in the present invention, the terminals 40A to 40C and 40E can be held without being lifted because of the operation of the ribs 18 and 19. Accordingly, the nuts 100 can be easily fastened to the stud bolts 14A to 14C and 14E even when the wires W are not held. It is therefore possible to sequentially fasten all of the nuts 100 using a tool after all of the terminals 40A to 40C and 40E with wire are fit on the respective stud bolts 100, thus increasing the efficiency of connecting the terminals 40A to 40C and 40E with wire to the fusible link unit 10.

What is claimed is:

1. A terminal connection structure in which a stud bolt is inserted into a bolt insertion hole of a top plate portion of a terminal, and a nut is screwed and fastened to the stud bolt on the top plate for connecting the terminal to the stud bolt, the structure comprising:

a terminal accommodation section formed by a tubular protection wall extended upwardly from the top plate of the terminal and around the stud bolt, having an opening and ribs formed on of a circumference thereof, the terminal accommodation section allowing the top plate portion of the terminal fixed to an end of a wire to be inserted in the tubular protection wall on the stud bolt, wherein the opening is formed so as to fit on a belt portion extending from a part of an outer peripheral edge of the top plate portion of the terminal toward a fixing portion of the terminal, wherein the ribs are protruded on right and left sides on an interior of the protection wall with respect to the opening, the ribs coming into contact with right and left side edges of the belt portion of the terminal and preventing the terminal from being detached upward when the terminal is temporarily lifted, wherein the ribs are arranged at different heights in a top-bottom direction of the stud bolt, and wherein the ribs respectively have guide slope surfaces in upper surfaces thereof, the guide slope surfaces sloping downward from a base side of the ribs toward a tip side of the ribs to facilitate the insertion of the terminal when the terminal to be inserted into the terminal accommodation section comes into contact with the ribs.

2. The terminal connection structure according to claim 1, wherein the ribs respectively have latch surfaces in lower surfaces thereof, the latch surfaces being normal to the protection wall, or having a slope sloping up from the tip side of the ribs to the base side of the ribs.

3. The terminal connection structure according to claim 1, wherein the fixing portion of the wire is bent downward in an L shape with respect to the belt portion, and the wire extends downward from the fixing portion of the wire.

4. The terminal connection structure according to claim 3, further comprising: wherein a plurality of the stud bolts and a plurality of the tubular protection walls are provided side by side in an upper surface of a component, a plurality of wire accommodation grooves formed on a side of the component, each of the wire accommodation grooves accommodates the fixing portion of the wire and an upper end part of the wire, and communicates with the opening of the tubular protection walls.

5. The terminal connection structure according to claim 4, wherein the top plate portion of the terminal is formed in a disk shape and includes a protrusion at a part of a circumference thereof, the tubular protection walls are cylindrical protection walls, each of the tubular protection walls has a recess fitting on each of the protrusions at a part of the circumference thereof, and the protrusions of the terminals are arranged at different circumferential positions from each other, and the recesses of the cylindrical protection walls are arranged at different circumferential positions corresponding to the protrusions.

6. The terminal connection structure according to claim 4, wherein the component is a fusible link unit directly mounted on a battery.

* * * * *